US005689398A

United States Patent [19]

Miller et al.

[11] Patent Number: 5,689,398

[45] Date of Patent: Nov. 18, 1997

[54] REDUNDANT CONTROL RELAY CIRCUITS

[75] Inventors: James P. Miller, Waukesha; Douglas P. Cleereman, Greendale, both of Wis.

[73] Assignee: Allen-Bradley Company, Inc., Milwaukee, Wis.

[21] Appl. No.: 582,248

[22] Filed: Jan. 3, 1996

[51] Int. Cl.[6] ..... H01H 47/00

[52] U.S. Cl. ..... 361/189; 361/166; 361/192; 307/140; 307/328; 192/129 A

[58] Field of Search ..... 361/166, 189, 361/191, 192; 307/116, 140, 326, 328; 192/129 A, 132 R

[56] References Cited

U.S. PATENT DOCUMENTS 3,213,330 10/1965 Teller ..... 361/189
3,493,780 2/1970 Wiggs et al. ..... 307/116
3,534,844 10/1970 Freeland ..... 192/129 A
4,185,208 1/1980 McMillen, Jr. et al. ..... 307/140

*Primary Examiner*—Jeffrey A. Gaffin
*Assistant Examiner*—Thuy-Trang N. Huynh
*Attorney, Agent, or Firm*—John M. Miller; John J. Horn

[57] ABSTRACT

Improved redundant relay control circuits are set forth which prevent a load from being energized when any relay coil or contact or stop or start switch contact fails. A first circuit embodiment sets forth a plurality of branches with a cross-monitoring interconnection between a start branch and one of the two other circuit branches. The interconnection prevents a load from being energized when a start switch welds. Second and third circuit embodiments are configured such that the redundant control relay circuit remains inoperative until a fault is cleared although the main power across the circuit is temporarily removed. A fourth circuit embodiment operates independent of relay contact timing.

9 Claims, 6 Drawing Sheets

REDUNDANT CONTROL RELAY CIRCUITS

FIELD OF INVENTION

This invention relates generally to relay circuits, and, more particularly to self-checking and cross-monitoring relay control circuits that permit a load to be deenergized when a fault is present and prevent the load from being re-energized until the fault is cleared.

BACKGROUND OF INVENTION

When electromechanical relays are used in safety related circuits there is a potential for failure in that circuit. Accordingly, several standards require that machine mounted switches, sensors and relay contacts used in control circuits utilize positively driven contacts, redundant outputs and cross or self-monitoring. An electromechanical switch is said to be positively driven when the actuator acts directly on the switching element via a non-resilient member, thus forcing disconnection of its contacts. In particular, positively guided relay contacts are designed to eliminate any springing of the contacts to ensure a true making and breaking and, in the case of a failure, to ensure that a minimum clearance between the open contacts is maintained. As a result, when either a normally open ("NO") or a normally closed ("NC") contact welds the opposite circuit will not make.

Redundancy, as referred to in the standards, is the provision of a duplicate circuit which will operate if the primary circuit fails. In essence, when considering relay systems, it is simply to include two or more relays with coils in parallel and contacts in series. Self-checking and cross-monitoring arises through the contacts in series with each relay's coils. A relay is said to be self-checked if one of its contacts determines whether its coil is energized or de-energized. Similarly a relay is cross-monitored when another relays contacts determine whether its coil is energized or de-energized.

FIG. 1 is an example of a prior art self-checked and cross-monitored redundant relay circuit. The circuit comprises three parallel main branches including a plurality of relay coils, relay contacts and switch contacts. The first branch comprises a first push/pull-stop/reset switch contact SP-1 in series with a NO cross-monitoring relay contact CR3-1 and a first relay coil RC-1. A second NO self-checking contact CR1—1 is in parallel with relay contact CR3-1. The second branch is almost identical to the first in that it comprises a second push/pull stop switch contact SP-2 in series with a third NO cross-monitoring relay contact CR3-2 and a second relay coil RC-2. A fourth NO self-checking contact CR2-1 is in parallel with relay contact CR3-2. The third and final branch comprises a start switch contact ST-1 in series with first and second NC cross-monitoring contacts CR1–2 and CR2—2 and a third relay coil RC-3. Additionally, for timing reasons a capacitor C1 is placed in parallel with the third relay coil RC-3.

When power is applied to the circuit relay coils RC-1, RC-2 and RC-3 are in a de-energized state with the NC cross-monitoring contacts CR1–2 and CR2—2 closed. No action is taken until the stop button is reset or pulled and the start switch ST-1 is depressed at which time control relay RC-3 is energized thereby closing the NO contacts CR3-1 and CR3-2 of control relay RC-3. When the stop button is in its reset (i.e. closed) position control relays RC-1 and RC-2 are energized almost simultaneously. In turn, control relays RC-1 and RC-2 begin energizing and break their NC cross-monitoring contacts which de-energizes control relay RC-3. A diode or capacitor C1 across control relay RC-3's coil slows its release long enough so that both control relays RC-1 and RC-2 can make their NO hold-in (self-checking) contacts CR1—1 and CR2-1 respectively. As shown in FIG. 2, the load is energized once control relays RC-1 and RC-2 are energized and their NO self-checking contacts CR1–3 and CR2–3 are closed and control relay RC-3 is de-energized such that NC contact CR3—3 is closed. Pushing the stop button opens contacts SP-1 and SP-2 releasing relay coils RC-1 and RC-2. Thereafter, pulling the stop button resets the circuit until the next time the start button's NO contact ST-1 is closed. Accordingly, if either control relay RC-1 or RC-2 fails to release from its energized position (i.e. welds) then control relay RC-3 cannot be energized when the start button is actuated since the NC cross-monitoring contact CR1–2 or CR2—2 of the failed relay will remain open. Similarly, if relay coil RC-3 fails to release the NC output contact CR3—3 is not opened and the load is not made.

Welding of either the NC stop button contacts SP-1 or SP-2 prevents the corresponding relay coils RC-1 or RC-2 respectively from de-energizing when the stop button is pushed. As discussed above, when relay coils RC-1 or RC-2 cannot deenergize then control relay RC-3 cannot be re-energized to start the cycle. However, if the main power across the circuit is turned off relay coils RC-1 and RC-2 will deenergize even though one or both of the stop button contacts SP-1 and SP-2 have welded. Additionally, if the NO start button contact ST-1 welds the load can be deenergized by actuating the stop button but the cycle will begin any time the NC contacts SP-1 and SP-2 of the stop button are made. As a result, the circuit shown in FIG. 1 will allow the operator to disengage the load when a single relay failure occurs and will prevent the control circuit from restarting. However, a single failure of the start switch contact ST-1 in the closed position will allow the load to be energized anytime the stop button is in the reset position. In this situation the operator could continue to energize and de-energize the load without repairing the fault by using the stop button as both a start and stop button by pushing and pulling same.

Accordingly, there is a present need for an improved redundant relay circuit that will not operate when a particular relay circuit coil or contact or a start or stop switch contact fails and will not operate until the fault is cleared even when the main power across the relay circuit is shut down.

SUMMARY OF THE INVENTION

Four improved control relay circuits are set forth which prevent engagement of a load when any relay coil or contact or stop or start switch contact fails. A further improvement, is disclosed in that each of the circuits shown will not operate until the fault is cleared.

The first control circuit comprises three main branches with an interconnection between a start branch and one of the other two branches. The interconnecting branch prevents the load from being energized when the start switch welds and is a significant improvement over the prior art. Second and third control circuits comprise different topologies and provide an added feature in that they will not operate until a fault is cleared even when the main power across the control circuit is temporarily shut down. In yet a fourth embodiment a circuit which provides all of the previous benefits and further is not dependent on timing. As a result, the fourth circuit does not require a delay element such as a diode or capacitor.

It is therefore a principal object of the present invention to provide a relay control circuit that permits a load to be de-energized in the presence of a fault.

It is an additional object of the present invention to provide a relay control circuit that prevents a load from being energized when a fault is present.

It is a further object of the present invention to provide a control relay circuit that prevents a load from being energized when a fault is present even when the main power across the control circuit is disengaged and re-engaged.

It is yet another object of the present invention to provide an improved cross-monitoring control relay circuit that is not timing dependent.

DETAILED DESCRIPTION OF THE PREFERRED EMBODIMENT

Figure 3:
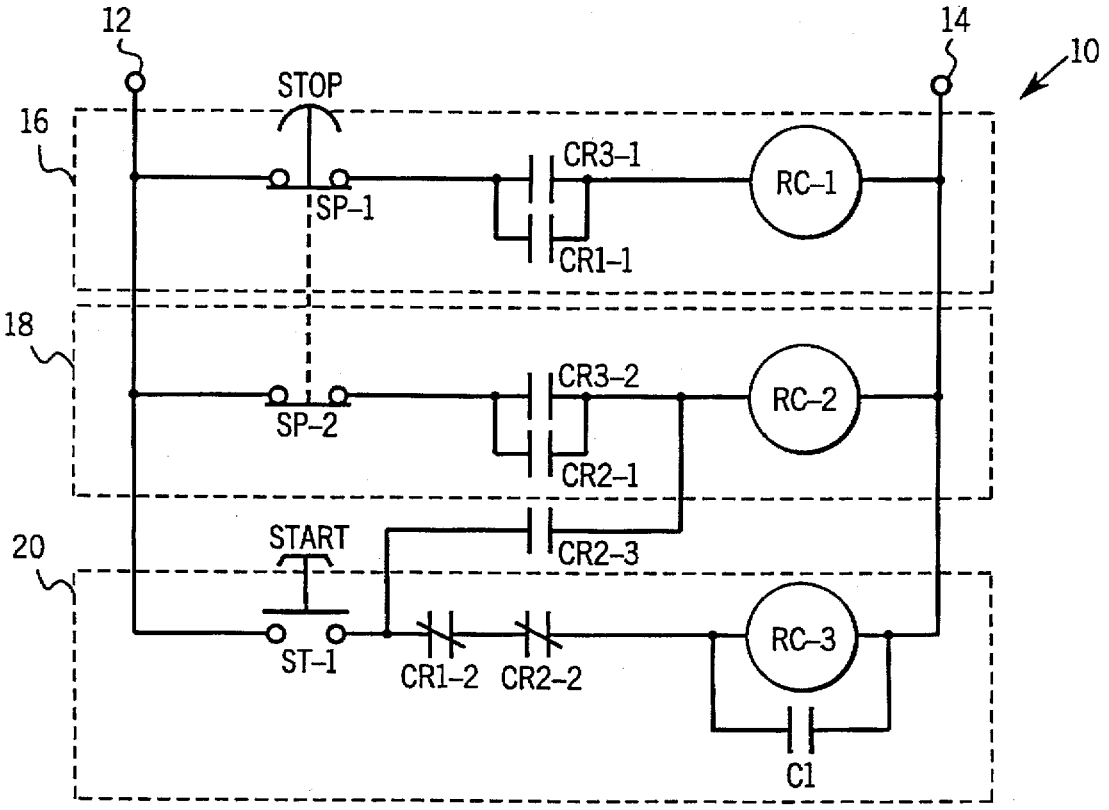
FIG. 3 is a schematic diagram of a control relay circuit in accordance with a first preferred embodiment of the present invention.
Figure 4:
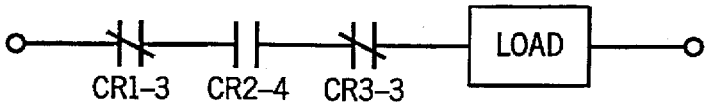
FIG. 4 is a schematic diagram of a load relay circuit in accordance with the first preferred embodiment.

With reference to FIGS. 3 and 4 there is shown a first preferred embodiment of a redundant self-checking and cross-monitoring relay circuit 10 of the present invention. As shown, the circuit 10 comprises three coils, nine contacts a push-pull stop/reset button and a start button. Power is supplied to the circuit across terminals 12 and 14.

As shown in FIG. 3 the circuit 10 comprises three main branches 16, 18 and 20 in parallel. The first branch 16 comprises a first push/pull-stop/reset switch contact SP-1 in series with a NO cross-monitoring relay contact CR3-1 and a first relay coil RC-1. A second NO self-checking contact CR1—1 is in parallel with relay contact CR3-1. The second branch 18 is almost identical to the first in that it comprises a second push/pull stop switch contact SP-2 in series with a third NO cross-checking relay contact CR3-2 and a second relay coil RC-2. A fourth NO self-checking contact CR2-1 is in parallel with relay contact CR3-2. The third and final branch 20 comprises a start switch contact ST-1 in series with first and second NC cross-monitoring contacts CR1–2 and CR2-2 and a third relay coil RC-3. For timing reasons a capacitor C1 is placed in parallel with the third relay coil RC-3 however a diode would work equally as well. In distinction from the prior art circuit shown in FIGS. 1 and 2 the improved circuit 10 further includes a fifth NO cross-linking contact CR2–3 which provides an added improvement over the prior art. Specifically, CR2–3 prevents the load from reenergizing once it has been de-energized when the start button contact ST-1 fails (i.e. welds).

In general, self-checking contacts are mechanically driven by the relay coil within the same parallel branch as the self-checking contact. As shown in the drawings, self-checking contacts are identified as CRx–y where "x" delineates the relay coil RC-x and "x" is the same for the contact and coil within the same parallel branch. Similarly, cross-monitoring contacts are mechanically driven by the relay coils of a parallel branch other than the one the contact is located in. As shown in the drawings, cross-monitoring contacts are identified as CRx–y where "x" delineates the relay coil RC-x and "x" is not the same for the contact and the coil within the same parallel branch.

When power is applied to the circuit relay coils RC-1, RC-2 and RC-3 are in a de-energized state with the NC cross-monitoring contacts CR1–2 and CR2—2 closed. When the start switch ST-1 is depressed control relay RC-3 is energized thereby closing the NO cross-monitoring contacts CR3-1 and CR3-2 of control relay RC-3. If the stop button is in its reset position (i.e. closed) control relays RC-1 and RC-2 are energized almost simultaneously. In turn, control relays RC-1 and RC-2 begin energizing and break their NC cross-monitoring contacts CR1–2 and CR2—2 which deenergizes control relay RC-3. Capacitor C1 across control relay coil RC-3 slows its release long enough so that control relay RC-1 can close NO hold-in (self-checking) contact CR1-1 and control relay CR2-1 and RC-3 respectively. Additionally, control relay RC-2 closes NO cross-linking contact CR2–3 which holds in coil RC-2 in the event the stop button welds.

As shown in FIG. 4, the load is energized once control relays RC-1 and RC-2 are energized and their NO contacts CR1-3 and CR2-3 are closed and control relay RC-3 is de-energized such that NC contact CR3-3 is closed. Pushing the stop button opens contacts SP-1 and SP-2 releasing relay coils RC-1 and RC-2. Thereafter, pulling the stop button resets the circuit until the next time the start button's NO contact ST-1 is closed. Accordingly, if either control relay RC-1 or RC-2 fails to release from its energized position (i.e. welds) then control relay RC-3 cannot be energized when the start button is actuated since the NC contacts CR1–2 or CR2—2 of the failed relay will remain open. Similarly, if relay coil RC-3 fails to release, the NC output contact CR3—3 will not close and the load is not made.

Figure 1:
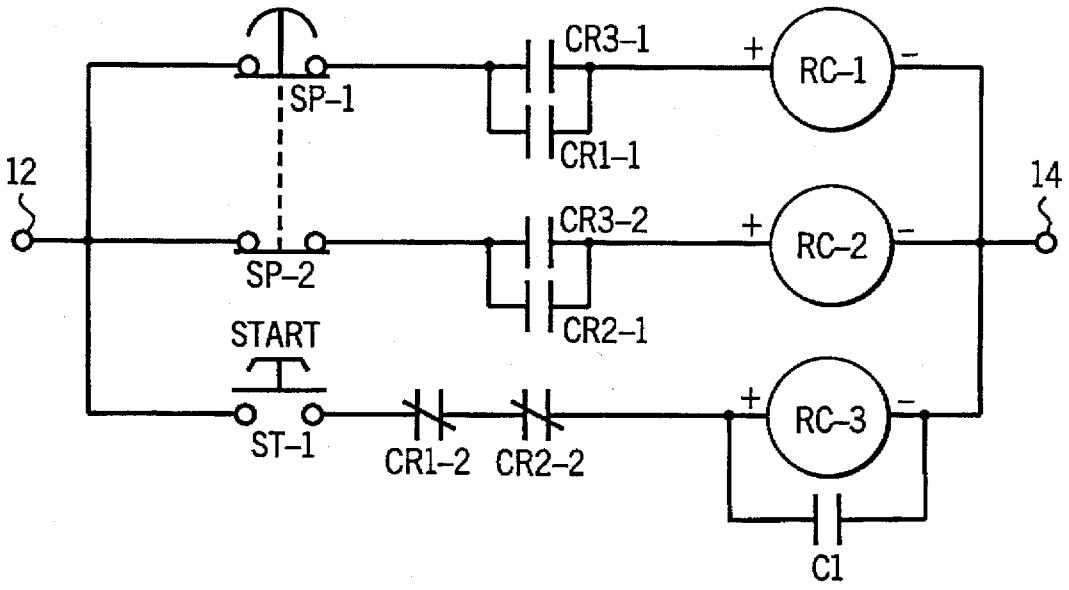
FIG. 1 PRIOR ART
FIG. 1 is a schematic diagram of a prior art relay control circuit.
Figure 2:
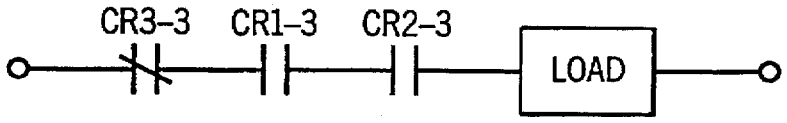
FIG. 2 PRIOR ART
FIG. 2 is a schematic diagram of a prior art relay load circuit in accordance with the circuit shown in FIG. 1.

The improved circuit 10 works in a manner similar to the prior art circuit shown in FIGS. 1 and 2 with a major advantage. Specifically, when the start buttons NO contact ST-1 is not opened before the stop button is actuated because the contacts are welded or the button mechanism is stuck down by accident or the operator holds the button down, control relay RC-2 will remain energized even when the stop button is actuated. Control relay RC-2 stays energized and prevents the start cycle from reoccurring until control relay 2 has been de-energized. This would normally be done by releasing the start button or breaking the welded NO contact ST-1 of the start button. However, when the power to the control circuit is removed by either the master control device or a power outage, control relay RC-2 will de-energize and the circuit will be reset and cycle without input from the operator when power returns assuming the NO contact ST-1 of the start button is still made.

With reference to FIG. 4 there is shown a load circuit which is mechanically driven by relay coils RC-1 through RC-3 of circuit 10 shown in FIG. 2. When circuit 10 operates properly NO contacts CR1–3 and CR2–4 are mechanically closed by relay coils RC-1 and RC-2 respectively while NC contact CR3—3 remains closed since RC-3 is de-energized. As such an uninterrupted current path between the source and the load is provided.

Figure 5:
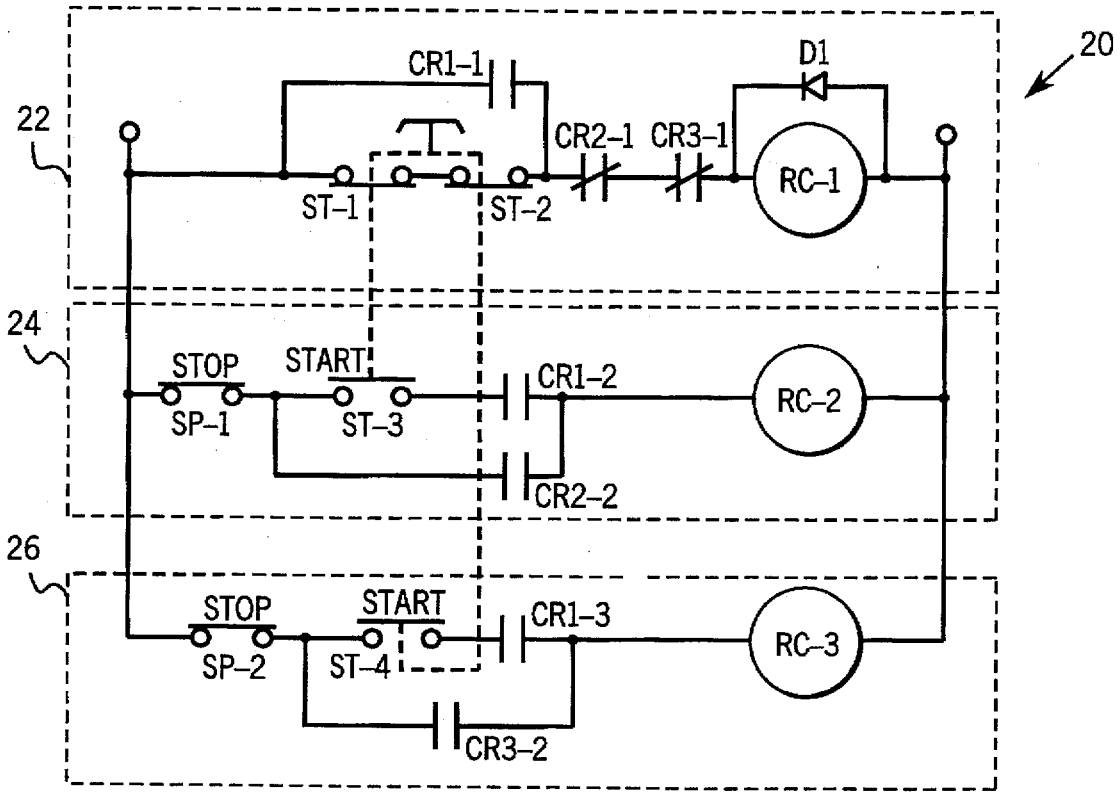
FIG. 5 is a schematic diagram of a control relay circuit in accordance with a second preferred embodiment of the present invention.
Figure 6:
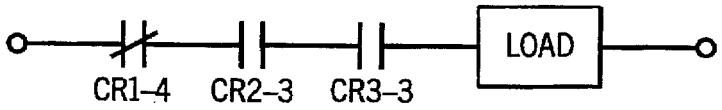
FIG. 6 is a schematic diagram of a load relay circuit in accordance with the second preferred embodiment.

A second preferred embodiment of the present invention is disclosed in a circuit 20 shown FIGS. 5 and 6. As shown in FIG. 5 the circuit 20 of the second embodiment comprises three main branches. Starting at a first, positive end, the first branch 22 includes a first NC start button contact ST-1 in series with a second NC start button contact ST-2 followed in series with NC contact CR2-1, NC relay contact CR3-1 and relay coil RC-1 respectively. Branch 22 further comprises a NO self-checking contact CR1—1 in parallel with the series combination of ST-1 and ST-2 and a diode D1 in parallel with coil RC-1. A second branch 24 comprises a first stop button contact SP-1 in series with a NO start button contact ST-3, a NO relay contact CR1–2 and a second relay coil RC-2. The second branch 24 further comprises a NO self-checking relay contact CR2—2 in parallel with the series combination of start button contact ST-3 and NO relay contact CR1–2. In a similar manner a third branch 26 comprises a second stop button contact SP-2 in series with a NO start button contact ST-4, a NO relay contact CR1-3 and a third relay coil RC-2 respectively. The third branch 26 further comprises a NO self-checking relay contact CR3-2 in parallel with the series combination of start button contact ST-4 and NO relay contact CR1–3.

The improved control relay circuit 20 overcomes the disadvantage of circuit 10 shown in FIG. 2 in that it will not re-cycle in the event of a power outage when a single fault is present. In particular, circuit 20 uses the NC contacts ST-1 and ST-2 of the start button to check that the NO contacts ST-3 and ST-4 are not welded or held down. When power is applied to the circuit and both NC start button contacts ST-1 and ST-2 are closed and relay coils RC-2 and RC-3 are de-energized, relay coil RC-1 will energize. Thereafter, when the operator actuates the start button the NC contacts ST-1 and ST-2 are broken but relay coil RC-1 is held in by NO self-checking contact CR1—1. With the NO start button contacts ST-3 and ST-4 closed and the NC stop button contacts SP-1 and SP-2 closed, relay coils RC-2 and RC-3 will energize and be held in by their NO contacts CR2—2 and CR3-2 respectively. When either of relay coils RC-2 or RC-3 breaks their NC contacts, relay coil RC-1 is de-energized but is delayed by use of a diode D1 such that coils RC-2 and RC-3 have adequate time to close. Alternately, a capacitor or other similar device which stores charge can be employed in place of diode D1. As shown in FIG. 6 the load is energized when relay coil RC-1 is de-energized and the NC contact CR1–4 is made and relay coils RC-2 and RC-3 are energized with their NO contacts CR2–3 and CR3—3 closed. In the event either NC contact ST-1 or ST-2 welds then the NO contacts ST-3 and ST-4 cannot close and relay coils RC-2 and RC-3 are not pulled in. Alternately, when either NO contact ST-3 or ST-4 of the start button is welded relay coil RC-1 cannot be pulled in. On the other hand, when one of the stop button contacts SP-1 or SP-2 welds the corresponding relay coil RC-2 or RC-3 respectively cannot de-energize however the load is disengaged via the coil of the non-faulted relay. Additionally, the load cannot be re-energized since the normally closed contact CR2-1 or CR3-1 corresponding to the faulted relay will prevent relay coil RC-1 from re-energizing. The same outcome occurs when either of relay coils RC-2 or RC-3 or both fail to de-energize. The failure or either coil to de-energize prevents relay coil RC-1 from re-energizing and starting the cycle. Finally, as shown in FIG. 6, when relay coil RC-1 fails to de-energize the load is not energized.

With reference to FIG. 6 there is shown a load circuit which is mechanically driven by relay coils RC-1 through RC-3 of circuit 20 shown in FIG. 5. When circuit 20 operates properly NO contacts CR2–3 and CR3—3 are mechanically closed by relay coils RC-2 and RC-3 respectively while NC contact CR1–4 remains closed since RC-1 is de-energized. As such an uninterrupted current path between the source and the load is provided.

Figure 7:
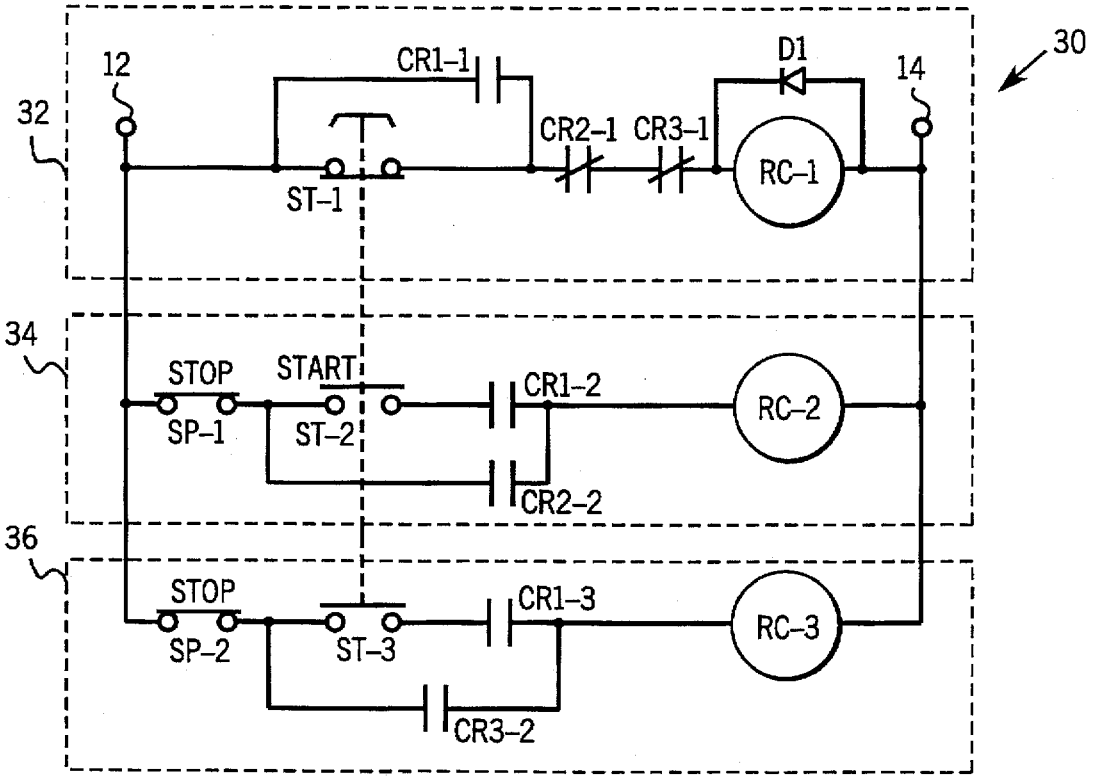
FIG. 7 is a schematic diagram of a control relay circuit in accordance with a third preferred embodiment of the present invention.

The control relay circuit 20 shown in FIG. 5 can be modified as shown in FIG. 7. Specifically, the circuit 30 shown in FIG. 7 is similar to the circuit 20 except it is simplified by removing one of the NC contacts (ST-2) from the start button. As shown, circuit 30 works in a similar manner as circuit 20 except when either of the NO start button contacts ST-2 or ST-3 is welded down. When this happens and power is applied to the circuit, or if the stop button is pushed and reset, relay coil RC-1 will energize normally. However, when relay coil RC-1 energizes it will cause relay coil RC-3 to energize which in turn will cause relay coil RC-1 to drop out. Since relay coil RC-1 cannot be re-energized relay coil RC-2 cannot be closed, and the load cannot be energized. In this instance, the load could not be energized in the presence of the fault unless the operator reset the stop button and then actuated the start button before the time delay of relay coil RC-1 expired.

Figure 8:
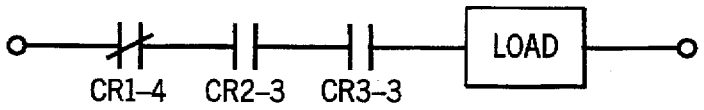
FIG. 8 is a schematic diagram of a load relay circuit in accordance with the third preferred embodiment.

With reference to FIG. 8 there is shown a load circuit which is mechanically driven by relay coils RC-1 through RC-3 of circuit 30 shown in FIG. 7. When circuit 30 operates properly NO contacts CR2–3 and CR3—3 are mechanically closed by relay coils RC-2 and RC-3 respectively while NC contact CR1–4 remains closed since RC-1 is de-energized. As such an uninterrupted current path between the source and the load is provided.

Figure 9:
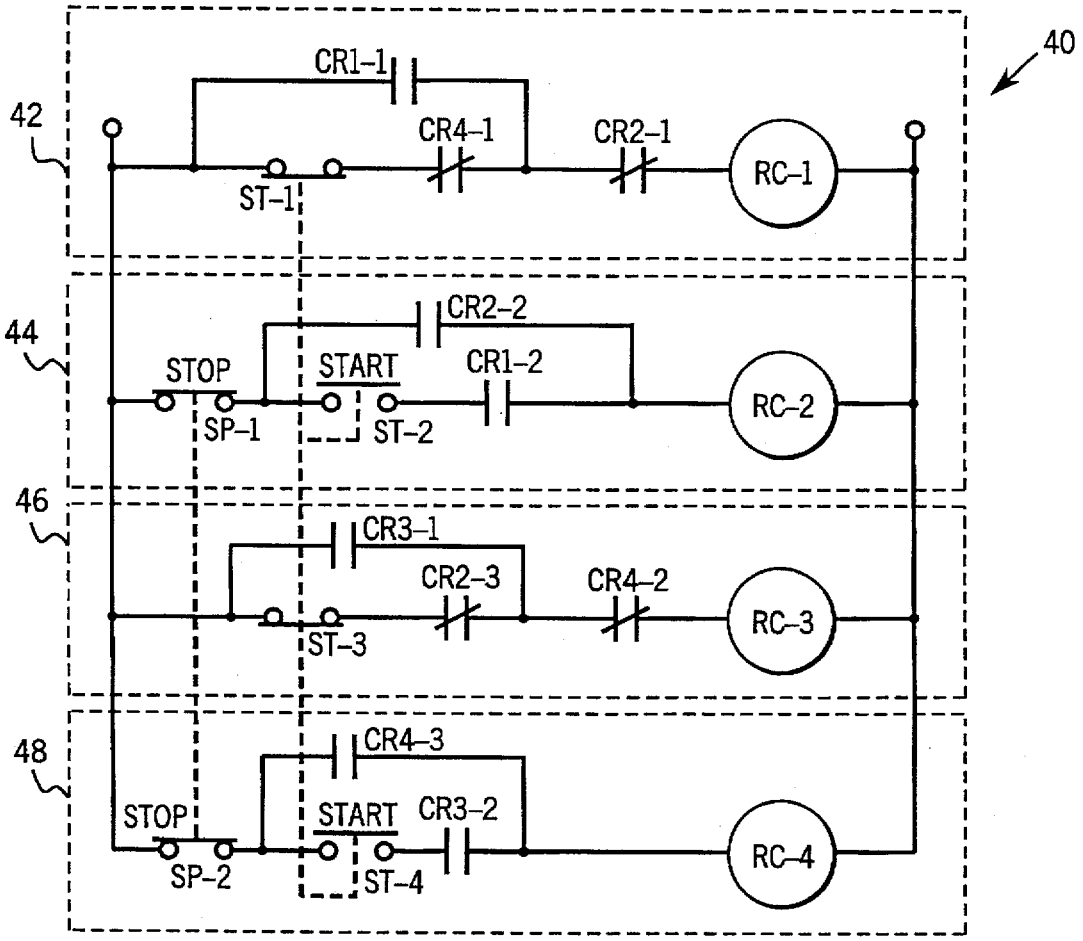
FIG. 9 is a schematic diagram of a control relay circuit in accordance with a fourth preferred embodiment of the present invention.
Figure 10:
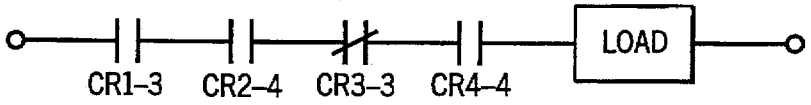
FIG. 10 is a schematic diagram of a load relay circuit in accordance with the fourth preferred embodiment.

A fourth preferred embodiment of the present invention is shown in FIGS. 9 and 10. This fourth relay control circuit 40 is comprised of four parallel branches 42–48 each branch comprising at least one coil. The first parallel branch 42, comprises a NC start switch contact ST-1 in series with a first NC cross-monitoring contact CR4-1, a second NC cross-monitoring contact CR2-1 and relay coil RC-1 respectively. Additionally, first branch 42 includes a NO self-checking contact CR1—1 in parallel with the series combination of start switch contact ST-1 and relay contact CR4-1. The second parallel branch 44 comprises a first stop switch contact SP-1 in series with a NO start switch contact ST-2, a NO cross-monitoring contact CR1–2 and a second relay coil RC-2. Branch 44 further includes a NO self-checking relay contact CR2—2 in parallel with the series combination of start switch contact ST-2 and NO relay contact CR1–2. The third parallel branch 46 is schematically similar to the first branch 42 except that the corresponding relay contacts in branches 42 and 46 are controlled by different relay coils. More specifically, branch 46 comprises a start switch contact ST-3 in series with NC cross-monitoring relay contact CR2–3, NC relay contact CR4-2 and a third relay coil RC-3. Branch 44 further comprises a NO self-checking relay contact CR3-1 in parallel with the series combination of NC start switch contact and NC relay contact CR2–3. The fourth and final branch 48 comprises a NC stop switch contact SP-2 in series with NO start switch contact ST-4, NO cross-monitoring relay contact CR3-2 and a fourth coil RC-4. Additionally branch 48 includes a NO self-checking relay contact CR4-3 in parallel with the series combination of start switch contact ST-4 and NO relay contact CR3-2.

Circuit 40 described above works differently and uses four relays. Specifically, circuit 40 does not require a diode or other device to delay release of one of its relay coils RC-1–RC-4 and therefore can be used in both AC and DC circuits. When power is applied and assuming the NC contacts ST-1 and ST-3 of the start button are closed and relay coils RC-2 and RC-4 are in de-energized positions, relay coils RC-1 and RC-3 are energized. Thereafter, when the start switches are actuated and the stop switch contacts SP-1 and SP-2 are closed, relay coils RC-2 and RC-4 are energized. Relay coils RC-1 and RC-3 drop out once the NC cross-monitoring contacts CR2-1 and CR4-2 break the circuits in branches 42 and 46. As shown in FIG. 10 the load is energized through the NC contacts CR1–3 and CR3—3 mechanically driven by relay coils RC-1 and RC-3 and the NO relay contacts CR2–4 and CR4—4 which are mechanically driven by relay coils RC-3 and RC-4 respectively. Branches 42–48 are independent of one other once relay coils RC-1 and RC-2 are energized. Accordingly, the timing of the start switch contacts is unimportant.

The failure modes of circuit 40 for a single failure are as follows. Failure to deenergize relay coils RC-1 or RC-3 prevents the load from being energized. Additionally, failure to de-energize relay coils RC-2 or RC-4 prevents relay coils RC-1 and RC-2 from energizing and starting the cycle. Similarly, when the NO contact ST-2 or ST-4 of a start switch fails to break, the corresponding NC contact ST-1 or ST-3 respectively cannot complete the circuit in branches 42 and 46 which prevents the cycle from occurring. Finally, failure of a stop switch contact SP-1 or SP-2 works similar to the previous circuits in that the relay in the circuit with the unopened stop switch (RC-2 or RC-4 respectively) does not de-energize which in turn prevents the cycle from starting over.

With reference to FIG. 10 there is shown a load circuit which is mechanically driven by relay coils RC-1 through RC-4 of circuit 40 shown in FIG. 9. When circuit 40 operates properly NO contacts CR2–4 and CR4—4 are mechanically closed by relay coils RC-2 and RC-4 respectively while NC contacts CR1–3 and CR3—3 remain closed since RC-1 and RC-3 are de-energized. As such an uninterrupted current path between the source and the load is provided.

Figure 11:
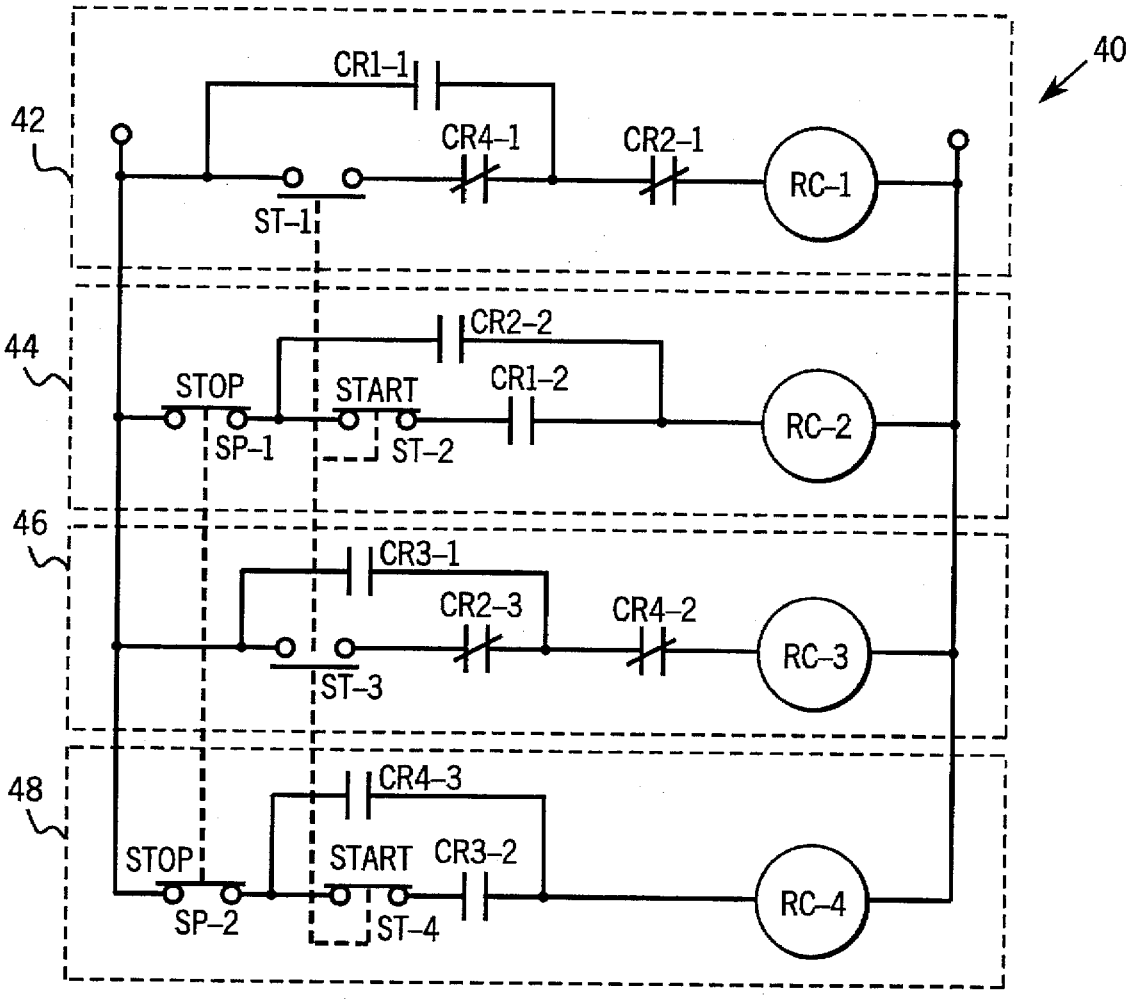
FIG. 11 is a schematic diagram of a control relay circuit of an alternative implementation of the fourth preferred embodiment of the present invention in which the operating position of the start switch contacts is mechanically modified.

In yet another embodiment as shown in FIG. 11 circuit 40 can be mechanically modified such that ST-1 and ST-3 are normally open and ST-2 and ST-4 are normally closed. In this embodiment the start button is configured such that when depressed RC-1 and RC-3 are energized and when released RC-2 and RC-4 are energized and the load is made. As such, coils RC-1 and RC-3 are not continuously maintained in the on position when the load is de-energized, thereby, decreasing the probability of failure and increasing the life of the circuit.

The instant invention has been shown and described herein in what is considered to be the most practical and preferred embodiment. It is recognized, however, that departures may be made therefrom within the scope of the invention and that obvious modifications will occur to a person skilled in the art. Additionally, wherever mentioned relay and switch contacts preferably are positively driven as is known in the art.

We claim:

1. An improved control relay circuit for connecting a power source to a load, said circuit comprising:

a first parallel branch comprising a first coil in series combination with a first parallel combination of a first self-checking contact and a first cross-monitoring contact;

a second parallel branch comprising a second coil in series combination with a second parallel combination of a second self-checking contact and a second cross-monitoring contact;

a third parallel branch comprising a third coil in series combination with a third cross-monitoring contact, a fourth cross-monitoring contact and a start switch contact, said third coil in parallel with a delay element;

a cross-linking contact, said cross-linking contact connected at a first point between said start switch contact and said fourth cross-monitoring contact and a second point between said second coil and said second parallel branch;

a first load circuit contact mechanically driven by said first coil;

a second load circuit contact mechanically driven by said second coil; and a third load circuit contact mechanically driven by said third coil;

wherein said first, second, and third load circuit contacts are connected between said power source and said load.

2. The improved control relay circuit as set forth in claim 1 further comprising a first stop switch contact in series with said first parallel branch and a second stop switch contact in series with said second parallel branch.

3. An improved control relay circuit for connecting a power source to a load, said circuit comprising:

a first parallel branch comprising a first relay coil, a first cross-monitoring contact, a second cross monitoring contact, a first start switch contact, and a second start switch contact in series combination, said first parallel branch further comprising a delay element in parallel with said first coil and a first self-checking contact in parallel with the series combination of said first and second start switch contacts;

a second parallel branch comprising a second coil, a third cross-monitoring contact, a third start switch contact, and a first stop switch contact in series combination, said second parallel branch further comprising a second self-checking contact in parallel with the series combination of said third cross-monitoring contact and said third start switch contact;

a third parallel branch comprising a third coil, a fourth cross-monitoring contact, a fourth start switch contact and a second stop switch contact in series combination, said third parallel branch further comprising a third self-checking contact in parallel with the series combination of said fourth cross-monitoring contact and said fourth start switch contact;

a first load circuit contact mechanically driven by said first coil;

a second load circuit contact mechanically driven by said second coil; and a third load circuit contact mechanically driven by said third coil;

wherein said first, second and third load circuit contacts are connected between said power source and said load.

4. The improved control relay circuit as set forth in claim 3 wherein said delay element comprises either a diode or a capacitor.

5. An improved control relay circuit for connecting a power source to a load, said circuit comprising:

a first parallel branch comprising a first relay coil, a first cross-monitoring contact, a second cross monitoring contact, and a first start switch contact in series combination, said first parallel branch further comprising a delay element in parallel with said first coil and a first self-checking contact in parallel with said first start switch contact;

a second parallel branch comprising a second coil, a third cross-monitoring contact, a second start switch contact, and a first stop switch contact in series combination, said second parallel branch further comprising a second self-checking contact in parallel with the series combination of said third cross-monitoring contact and said second start switch contact;

a third parallel branch comprising a third coil, a fourth cross-monitoring contact, a third start switch contact and a second stop switch contact in series combination, said third parallel branch further comprising a third self-checking contact in parallel with the series combination of said fourth cross-monitoring contact and said third start switch contact;

a first load circuit contact mechanically driven by said first coil;

a second load circuit contact mechanically driven by said second coil; and a third load circuit contact mechanically driven by said third coil;

wherein said first, second and third load circuit contacts are connected between said power source and said load.

6. The improved control relay circuit according to claim 5 wherein said delay element comprises either a diode or a capacitor.

7. An improved control relay circuit for connecting a power source to a load, said circuit comprising:

a first parallel branch comprising a first coil, a first cross-monitoring contact, a second cross monitoring contact and a first start switch contact in series combination, said first parallel branch further comprising a first self-checking contact in parallel with said series combination of said second cross-monitoring contact and said first start switch contact;

a second parallel branch comprising a second coil, a third cross-monitoring contact, a second start switch contact, and a first stop switch contact in series combination, said second parallel branch further comprising second self-checking contact in parallel with said series combination of said third cross-monitoring contact and said second start switch contact;

a third parallel branch comprising a third coil, a fourth cross-monitoring contact, a fifth cross-monitoring contact and a third start switch contact in series combination, said third parallel branch further comprising a third self-checking contact in parallel with said series combination of said fifth cross-monitoring contact and said third start switch contact;

a fourth parallel branch comprising a fourth coil, a sixth cross-monitoring contact, a fourth start switch contact, and a second stop switch contact in series combination, said fourth parallel branch further comprising fourth self-checking contact in parallel with said series combination of said sixth cross-monitoring contact and said fourth start switch contact;

a first load circuit contact mechanically driven by said first coil;

a second load circuit contact mechanically driven by said second coil;

a third load circuit contact mechanically driven by said third coil; and a fourth load circuit contact mechanically driven by said fourth coil;

wherein said first, second, third and fourth load circuit contacts are connected between said power source and said load.

8. An improved self-monitoring control circuit for connecting a power source to a load, said circuit comprising:

a first parallel relay circuit comprising a first parallel branch having first normally open contact in parallel with a series combination of a first start switch contact and a first normally closed contact, said first branch in series with a second normally closed contact and a first coil;

a second parallel relay circuit comprising a first stop switch contact in series with a second parallel branch having a second normally open contact in parallel with a series combination of a second start switch contact and a third normally open contact, said second parallel branch in series with a second coil;

a third parallel relay circuit comprising a third parallel branch having a fourth normally open contact in parallel with a series combination of a third start switch contact and a third normally closed contact, said third parallel branch in series with a fourth normally closed contact and a third coil;

a fourth parallel relay circuit comprising a second stop switch contact in series with a fourth parallel branch having a fifth normally open contact in parallel with a series combination of a fourth start switch contact and a sixth normally open contact, said fourth parallel branch in series with a fourth coil;

a first load circuit contact mechanically driven by said first coil;

a second load circuit contact mechanically driven by said second coil;

a third load circuit contact mechanically driven by said third coil; and a fourth load circuit contact mechanically driven by said fourth coil;

wherein said first, second, third and fourth load circuit contacts are connected between said power source and said load.

9. The improved self-monitoring control circuit according to claim 8 further comprising:

a start button; said start button configured such that said first and third start switch contacts are normally open and said second and fourth start switch contacts are normally closed.

* * * * *